US011866801B2

(12) United States Patent
Lu et al.

(10) Patent No.: US 11,866,801 B2
(45) Date of Patent: Jan. 9, 2024

(54) METHOD FOR OPTIMIZING MICROSTRUCTURE OF RAIL WELDED JOINT

(71) Applicant: PanGang Group Panzhihua Iron & Steel Research Institute Co., Ltd., Panzhihua (CN)

(72) Inventors: Xin Lu, Panzhihua (CN); Dadong Li, Panzhihua (CN); Wei Bai, Panzhihua (CN); Feixiang Xu, Panzhihua (CN)

(73) Assignee: PanGang Group Panzhihua Iron & Steel Research Institute Co., Ltd., Panzhihua (CN)

( * ) Notice: Subject to any disclaimer, the term of this patent is extended or adjusted under 35 U.S.C. 154(b) by 89 days.

(21) Appl. No.: 17/477,073

(22) Filed: Sep. 16, 2021

(65) Prior Publication Data

US 2022/0119912 A1 Apr. 21, 2022

(30) Foreign Application Priority Data

Oct. 21, 2020 (CN) ..... 202011134208.4

(51) Int. Cl.

| | |
|---|---|
| ***C21D 9/50*** | (2006.01) |
| ***C21D 8/00*** | (2006.01) |
| ***C21D 9/04*** | (2006.01) |

(52) U.S. Cl.

CPC ..... *C21D 9/505* (2013.01); *C21D 8/005* (2013.01); *C21D 9/04* (2013.01); *C21D 2211/003* (2013.01); *C21D 2211/009* (2013.01)

(58) Field of Classification Search

CPC ..... C21D 8/005; C21D 9/04; C21D 9/505; C21D 2211/003; C21D 2211/009

See application file for complete search history.

(56) References Cited

U.S. PATENT DOCUMENTS

2012/0012296 A1* 1/2012 Sugiyama ..... C21D 9/505 165/200
2012/0087825 A1* 4/2012 Miyazaki ..... C22C 38/04 420/99

FOREIGN PATENT DOCUMENTS

| | | | |
|---|---|---|---|
| CN | 1178250 | A | 4/1998 |
| CN | 103898310 | A | 7/2014 |
| CN | 104001741 | A | 8/2014 |
| CN | 106544933 | A | 3/2017 |
| CN | 109355481 | A | 2/2019 |
| CN | 110016544 | A | 7/2019 |

(Continued)

*Primary Examiner* — Sally A Merkling
*Assistant Examiner* — Dean Mazzola
(74) *Attorney, Agent, or Firm* — Volpe Koenig

(57) ABSTRACT

The present disclosure relates to the technical field of rails welding, and particularly to a method for optimizing microstructure of a rail welded joint, the method comprises the following steps: step 1): subjecting a rail web area of a to-be-cooled welded joint which is obtained by flash butt welding to an accelerated cooling by means of an accelerated cooling device and by using compressed air as a cooling medium, measuring and monitoring temperature of a central position of the rail web of the welded joint while cooling; step 2): stopping the accelerated cooling when the temperature of the central position of the rail web drops to a preset temperature, then placing the welded joint in air and naturally cooling to room temperature, wherein the rail is a pearlite rail having a carbon content of 0.6-0.9 wt %.

9 Claims, 3 Drawing Sheets

(56) References Cited

FOREIGN PATENT DOCUMENTS

| | | | | | |
|---|---|---|---|---|---|
| CN | 110358906 | A | | 10/2019 | |
| KR | 20010077052 | A | * | 8/2001 | ..... C21D 9/04 |

* cited by examiner

METHOD FOR OPTIMIZING MICROSTRUCTURE OF RAIL WELDED JOINT

CROSS REFERENCE TO RELATED APPLICATION

This application claims priority to Chinese Application No. 202011134208.4, filed on Oct. 21, 2020, entitled "A METHOD FOR OPTIMIZING MICROSTRUCTURE OF RAIL WELDED JOINT", which is herein specifically and entirely incorporated by reference.

FIELD OF INVENTION

The present disclosure relates to the technical field of rail welding, and particularly to a method for optimizing microstructure of a rail welded joint.

BACKGROUND

Along with the rapid development of seamless rail line technologies in the world for the railway construction of passenger transport, freight transport and high-speed, and heavy-haul transit line, the quality of the rail joints have attracted increasing attention from the relevant departments. The railway line is a direct carrier for the train operation, the reliability of the railway line quality is vital for the safe train operations. The rail flash butt welding joints are weaknesses in the overall rail line, the quality of said welded joints may directly affect the safety of the railway, and the microstructure of the rail joints directly determine the performance of the welded joints in use.

Currently, the mainstream rails at home and abroad are pearlite rails. The microstructure of the welded joint is specified in detail in all the current standards and the enterprise specifications applicable to the pearlite rail flash butt weld. It is stipulated in the Chinese railway industry standard TB/T 1632.2-2014 "Rail Welding Part 2: Flash butt weld" that the microstructure of the weld and the heat affected zone of the rail welded joint should be pearlite, which may contain a small amount of ferrite, but the harmful microstructures such as martensite or bainite shall not be present; American Railway Engineering and Maintenance-of-way Association (AREMA) specifies in its standards that 100% pearlite is desired in the weld and heat affected zone of a rail welded joint, once an untempered martensite occurs, the results of the slow bend test will be affected; BS EN 14587-3: 2012, Rail way applications-Track-Flash butt Welding of rails. Part 3: Welding in association with crossing construction specifies that, when viewed with an optical microscope at a magnification of 100×, the acicular carbide with evidence of embrittlement and continuous networks of intergranular carbide shall not be observed, but the granular martensite microstructure is allowed; AS 1085.20-2012, Rail way Track material Part 20: Welding of rail specifies that the microstructure of the rail joint should be a pearlite essentially free of intergranular cementite and untempered martensite, the presence of a small amount of martensite may be allowed if the other test requirements are met; the location and size of intergranular carbide allowed to present in the rail joint are also specified in the technical specifications of many well-known heavy-haul rail lines in foreign countries.

It is evident from the above standards and technical specifications that the various countries in the world have imposed extremely high requirements on the morphology and content of the intergranular cementite structure in the welded joint of the pearlite rail flash butt weld, which are even more strict than the allowable content range of the harmful structures such as martensite and bainite. As regards how to inhibit or eliminate precipitation of the intergranular carbide structure of the welded joints of pearlite rail by means of the welding process and the post-weld treatment process, it is an important factor for obtaining the high quality welded joint of the pearlite rail flash butt weld.

Intergranular cementite refers to the cementite distributed between crystalline grains along the grain boundaries. Cementite is an interstitial compound Fe3C of iron and carbon, with the carbon content of 6.99%. Cementite belongs to the orthogonal crystal system, its crystal structure is quite complex, each crystal cell contains 12 iron atoms and 4 carbon atoms. Cementite has a very high hardness of about 800 HBW, but it has very poor plasticity with an elongation close to zero. Cementite has some ferromagnetism under a low temperature, but 230° C. is the magnetic transition temperature of the cementite. The melting point of cementite is 1,227° C. based on the theoretical calculation. The cementite with a complex structure is the most common and important carbide in the steel, is also one of the precipitated phases in the iron and steel. Regardless of the cementite applied as a product of eutectoid or eutectic transformation, the existing form and the existential state of the cementite in the steel (e.g. change of valence state of Fe and C, crystalline state and amorphous state, geometrical shape, size, number and distribution of Fe3C) will directly influence the properties of steel. Depending on its precipitation location, the cementite may be classified into a primary cementite which precipitates from the liquid phase, a secondary cementite which precipitates from the austenite, and a tertiary cementite which precipitates from the ferrite. The primary cementite is in a white strip shape and distributed between the ledeburites; the secondary cementite generally precipitates along the original austenite grain boundaries, the secondary cementite is distributed as a continuous network on the pearlite boundaries after the austenite is transformed into pearlite; the tertiary cementite is distributed on the ferrite grain boundaries, but it is generally invisible because that it has a small amount and an extremely scattered state.

In the steel with the ingredients and system of the existing rail, the cementite mainly exists in the form of flakes and network. The lamellar cementite is the main existing form of cementite in the steel, it is generally derived from the eutectoid transformation, the lamellar pearlite is composed of the lamellar cementite and the flake-shaped ferrite. The network cementite, also known as the proeutectoid cementite, precipitates along the intergranular boundary from the austenite having a high carbon content than the eutectoid due to change of the carbon content during a temperature reduction process, it is usually presented in the eutectoid steel or hypereutectoid steel, which generally has a network shape, thus it is also known as network cementite. The presence of network cementite will greatly increase brittleness of the steel. At present, the carbon content of the rail widely used in the ordinary rail lines (e.g., passenger transport and subway) at home and abroad is generally within a range of 0.61-0.82%, which is close to the carbon content 0.77% of the eutectoid point in the equilibrium state, but the carbon content of the eutectoid point may decrease to about 0.71% with the influence of some alloying elements; in addition, the central position of the rail web produced following the continuous casting and rolling is usually the normal segregation region of ingredients, which has a high carbon content, the intergranular cementite having a network-like distribution is easily precipitated during the welding process, the welding quality of the welded joint will be lowered in the case of serious precipitation.

Currently, there are a few technical documents and invention patents on the process research of suppressing the precipitation of intergranular cementite from the rail welded joints.

SUMMARY

The present disclosure aims to overcome the existing problem in the prior art with respect to the microstructure anomalies caused by precipitation of intergranular cementite from the rail welded joints, and provide a method for optimizing microstructure of a rail welded joint.

In order to achieve the above-mentioned purpose, the present disclosure provides a method for optimizing microstructure of a rail welded joint, wherein the method comprises the following steps:

Step 1): subjecting a rail web area of a to-be-cooled welded joint which is obtained by flash butt welding to an accelerated cooling by means of an accelerated cooling device and by using compressed air as a cooling medium, measuring and monitoring temperature of a central position of the rail web of the welded joint while cooling;

Step 2): stopping the accelerated cooling when the temperature of the central position of the rail web drops to a preset temperature, then placing the welded joint in air and naturally cooling to room temperature;

wherein the rail is a pearlite rail having a carbon content of 0.6-0.9 wt %.

Preferably, a pressure of the compressed air in step 1) is within a range of 0.3-0.6 MPa.

Preferably, the rail is a hot-rolled pearlite rail and/or a heat-treated pearlite rail.

Preferably, the accelerated cooling device in step 1) is a box-like cavity structure comprising a cooling medium inlet surface through which the cooling medium enters the accelerated cooling device, and a cooling surface through which the cooling medium is ejected.

Preferably, a plurality of cone-type wide angle nozzles are equidistantly distributed on the cooling surface;

Preferably, the spray angle of the cone-type wide angle nozzles is within a range of 110-115°.

Preferably, the rail web area of a welded joint in step 1) comprises a region having a height of two-thirds of the rail web height along the height direction and a region having a width extending 40 mm outwardly from the heat affected zone of the welded joint along the width direction.

Preferably, the rail web area of a welded joint comprises a region having a height extending 20-30 mm from a centerline of the rail weld to both sides along the height direction of the rail, and a region having a width extending 40-60 mm outwardly from a centerline of the weld along the width direction of the weld.

Preferably, a distance between the cooling surface of the accelerated cooling device and the rail web surface in step 1) is within a range of 5-35 mm.

Preferably, the cooling rate at the central position of the rail web during the accelerated cooling process in step 1) is larger than 18° C./s;

It is further preferred that the cooling rate at the central position of the rail web is within a range of 19-35° C./s.

Preferably, the preset temperature in step 2) is within a range of 800-1,100° C.

The method of the present disclosure is targeted at the pearlite rail having a carbon mass fraction of 0.6-0.9%, it takes advantage of residual heat of the rail welded joint and does not require to reheat the joint, the method can effectively ensure normality of the abnormal structure such as intergranular cementite in the welded joint of the pearlite rail flash butt weld, and guarantee that the hardness, slow bend test and other property of welded joint meet requirements in use. The present disclosure has significant effects, a simple technological process, and an easy operation, it is applicable to both the fixed flash butt welding and the mobile flash butt welding.

DESCRIPTION OF THE REFERENCE SIGNS

Figure 1:
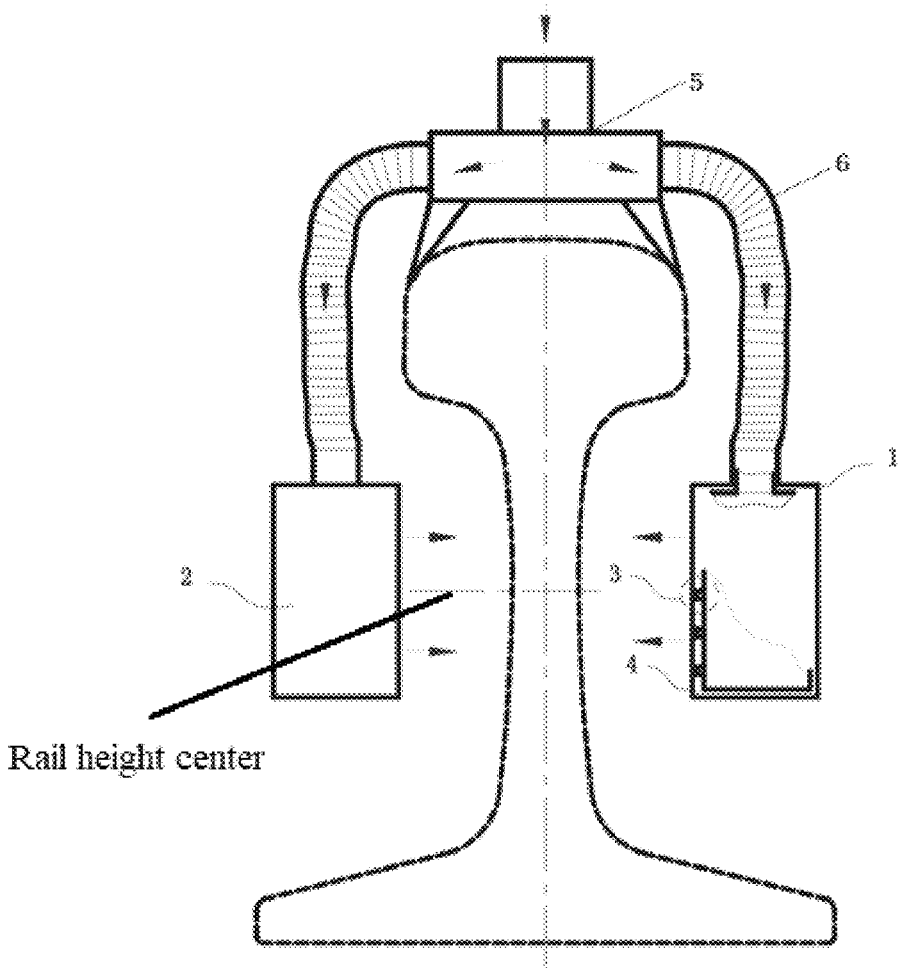
FIG. 1 is a schematic view showing the installation of an accelerated cooling device of the present disclosure.

1. Cooling medium inlet surface
2. Accelerated cooling device
3. Cone-type wide angle nozzle
4. Cooling surface
5. Fixator
6. Pipeline

DETAILED DESCRIPTION

The following content describes in detail the embodiments of the present disclosure with reference to the appended drawings. It should be comprehended that the specific embodiments described herein merely serve to illustrate and explain the present disclosure, instead of imposing limitation thereto.

The terminals and any value of the ranges disclosed herein are not limited to the precise ranges or values, such ranges or values shall be comprehended as comprising the values adjacent to the ranges or values. As for numerical ranges, the endpoint values of the various ranges, the endpoint values and the individual point values of the various ranges, and the individual point values may be combined with one another to produce one or more new numerical ranges, which should be deemed have been specifically disclosed herein.

The present disclosure provides a method for optimizing microstructure of a rail welded joint, wherein the method comprises the following steps:

Step 1): subjecting a rail web area of a to-be-cooled welded joint which is obtained by flash butt welding to an accelerated cooling by means of an accelerated cooling device and by using compressed air as a cooling medium, measuring and monitoring temperature of a central position of the rail web of the welded joint while cooling;

Step 2): stopping the accelerated cooling when the temperature of the central position of the rail web drops to a preset temperature, then placing the welded joint in air and naturally cooling to room temperature;

wherein the rail is a pearlite rail having a carbon content of 0.6-0.9 wt %.

In the present disclosure, "subjecting a rail web area of a to-be-cooled welded joint which is obtained by flash butt welding to an accelerated cooling" means that the rail web area is immediately subjected to the accelerated cooling while the flash butt welding is finished, so as to sufficiently take advantage of the residual heat of the rail welded joint.

In the present disclosure, the flash butt welding of rails refers to a welding method in which two rails on both sides are clamped by a clamping device such as a conductive electrode, and the ends of the rails are brought into contact with each other after energized, a resistance heat is generated by the conduction current at the contact points, so that the contact points are rapidly melted, a flash is formed accompanied with an intense splashing, an upsetting force is applied after subjecting to a certain amount of the flash allowance, thereby allowing the rails to be recrystallized and formed at a high temperature. The flash butt welding method is mainly divided into a fixed flash butt welding and a mobile flash butt welding.

The present disclosure does not impose specific requirements for the equipment used for flash butt welding, which may be various flash butt welding machine conventionally used in the art.

In the present disclosure, the compressed air is used as a cooling medium, it is preferable that the compressed air has a pressure within a range of 0.3-0.6 MPa. Specifically, a pressure of the compressed air may be 0.3 MPa, 0.31 MPa, 0.32 MPa, 0.33 MPa, 0.34 MPa, 0.35 MPa, 0.36 MPa, 0.37 MPa, 0.38 MPa, 0.39 MPa, 0.4 MPa, 0.41 MPa, 0.42 MPa, 0.43 MPa, 0.44 MPa, 0.45 MPa, 0.46 MPa, 0.47 MPa, 0.48 MPa, 0.49 MPa, 0.5 MPa, 0.51 MPa, 0.52 MPa, 0.53 MPa, 0.54 MPa, 0.55 MPa, 0.56 MPa, 0.57 MPa, 0.58 MPa, 0.59 MPa or 0.6 MPa.

In the present disclosure, the pressure refers to an absolute pressure.

In the method of the present disclosure, the rail is a hot-rolled pearlite rail and/or a heat-treated pearlite rail.

In the present disclosure, the pearlite rail refers to a rail whose microstructure is entirely composed of pearlite in the state of supply.

In the method of the present disclosure, it is preferable that in step 1), an infrared thermometer is used for measuring and monitoring temperature of a central position of the rail web of the welded joint.

In the present disclosure, the central position of the rail web refers to the weld center of the rail web area that is subjected to an accelerated cooling.

In the method according to the present disclosure, there are no special requirements regarding the selection of the accelerated cooling device in step 1), which may be various accelerated cooling devices conventionally used in the field. In the preferred circumstance, the accelerated cooling device 2 is a box-like cavity structure, which mainly servers to disperse a concentrated cylindrical cooling medium, the accelerated cooling device 2 comprises a cooling medium inlet surface 1 through which the cooling medium enters the accelerated cooling device 2, and a cooling surface 4 through which the cooling medium is ejected.

In a more preferred circumstance, a plurality of cone-type wide angle nozzles 3 are equidistantly distributed on said cooling surface 4.

It is further preferred that the spray angle of the cone-type wide angle nozzles (3) is within a range of 110-115°.

In a preferred embodiment, the cooling surface 4 of the accelerated cooling device 2 in step 1) is a plane facing the rail web surface, and also a plane being closest to the rail web surface of the rail joint, the distance between the cooling surface 4 and the rail web surface may be arranged according to the magnitude of the cooling medium pressure. In a more preferred embodiment, the distance between the cooling surface 4 and the rail web surface is within a range of 5-35 mm. In a specific embodiment, the distance may be 5 mm, 10 mm, 15 mm, 20 mm, 25 mm, 30 mm or 35 mm.

In a preferred embodiment, FIG. 1 is a schematic view showing the installation of an accelerated cooling device of the present disclosure. A fixator 5, which is disposed above the rail, secures two accelerated cooling devices 2 to the both sides of the rail joint through a pipeline 6, and maintains the cooling surface 4 to be facing the rail web surface, the pipeline 6 is connected with cooling medium inlet surface 1 of the accelerated cooling device 2. When in use, the cooling medium enters the accelerated cooling device 2 after passing through the fixator 5, the pipeline 6 and the cooling medium inlet surface 1 in sequence, and is then ejected from the cone-type wide angle nozzles 3 of the cooling surface 4, a spray angle is within a range of 110-115°.

In a preferred embodiment, the rail web area of a welded joint in step 1) comprises a region having a height of two-thirds of the rail web height along the height direction and a region having a width extending 40 mm outwardly from the heat affected zone of the welded joint along the width direction.

It is further preferred that the rail web area of a welded joint comprises a region having a height extending 20-30 mm from a centerline of the rail weld to both sides along the height direction of the rail, and a region having a width extending 40-60 mm outwardly from a centerline of the weld along the width direction of the weld.

In a preferred embodiment, during step 1), the cooling rate at the central position of the rail web during the accelerated cooling process in step 1) is larger than 18° C./s. In a more preferred embodiment, the cooling rate at the central position of the rail web is within a range of 19-35° C./s.

In a preferred embodiment, the preset temperature in step 2) may be determined according to rail profile and rail grade. In a preferred embodiment, the preset temperature is within a range of 900-1,200° C. In particular, the preset temperature may be 800° C., 850° C., 900° C., 950° C., 1,000° C., 1,050° C. or 1,100° C.

In the present disclosure, the properties of said rail welded joints are also associated with the hardness, the load and deflection of the slow bend test thereof. The use of the post-weld treatment process of the present disclosure can improve the joint structure, reduce softening degree, and meet the wear resistance requirements of the joint.

The method of the present disclosure takes advantage of residual heat of the welded joint, does not require to reheat the rail welded joint, and can effectively ensure normality of the abnormal microstructure such as intergranular cementite in the welded joint of the hot-rolled or heat-treated pearlite rail flash butt weld having a carbon mass fraction of 0.6-0.9%, and guarantee that the hardness, slow bend and other property of welded joint meet requirements in use. The present disclosure has significant effects, a simple technological process, and an easy operation, it is applicable to both the fixed flash butt welding and the mobile flash butt welding.

The present disclosure will be described in detail below with reference to example, but the protection scope of the present disclosure is not limited thereto.

The accelerated cooling device 2 used in the examples and the comparative examples is a box-like cavity structure, which mainly servers to disperse a concentrated cylindrical cooling medium, the accelerated cooling device 2 comprises a cooling medium inlet surface 1 and a cooling surface 4. A schematic view of the installation of an accelerated cooling device is as shown in FIG. 1. A fixator 5, which is disposed above the rail, secures two accelerated cooling devices 2 to the both sides of the rail joint through a pipeline 6, and maintains the cooling surface 4 to be facing the rail web surface, the pipeline 6 is connected with cooling medium inlet surface 1 of the accelerated cooling device 2. When in use, the cooling medium enters the accelerated cooling device 2 after passing through the fixator 5, the pipeline 6 and the cooling medium inlet surface 1 in sequence, and is then ejected from a plurality of cone-type wide angle nozzles 3 which equidistantly distributed on the cooling surface 4.

The rail web area of the welded joint in the examples and comparative examples comprises a region having a height extending 20-30 mm from a centerline of the rail weld to both sides along the height direction of the rail, and a region having a width extending 40-60 mm outwardly from a centerline of the weld along the width direction of the weld.

Example 1

The experimental material of this example was railhead hardened (heat-treated) pearlite rail having a 68 kg rail profile stipulated by AS 1085.1: Railway track materials, Part 1: Rails, wherein the measured carbon content of the chemical composition of the rail entity was 0.8 wt %. Five parallel experiments were conducted, and the specific procedure included the following steps: a welding experiment was carried out by using a GAAS80/580 rail fixed flash butt welding machine, an accelerated cooling device 2 (the distance between the cooling surface 4 from the rail web surface was 15 mm, the spray angle was 110°) was adopted, the compressed air (with a pressure of 0.4 MPa) was used as a cooling medium, a rail web area of a to-be-cooled welded joint which was obtained by flash butt welding was subjected to an accelerated cooling, and an infrared thermometer was used for measuring temperature of a central position of the rail web of the welded joint and continuously monitoring the temperature, the cooling rate at the central position of the rail web was within a range of 19-35° C./s; when the temperature was dropped to 1,000° C., the control system automatically switched off the cooling medium, immediately stopped the accelerated cooling process, the welded joint was placed in air and naturally cooled to room temperature. The rail welded joints A11, A12, A13, A14 and A15 were obtained.

Example 2

The experimental material of this example was railhead hardened (heat-treated) pearlite rail having a 68 kg rail profile stipulated by AS 1085.1: Railway track materials, Part 1: Rails, wherein the measured carbon content of the chemical composition of the rail entity was 0.8 wt %. Five parallel experiments were conducted, and the specific procedure included the following steps: a welding experiment was carried out by using a rail mobile flash butt welding machine, an accelerated cooling device 2 (the distance between the cooling surface 4 from the rail web surface was 15 mm, the spray angle was 110°) was adopted, the compressed air (with a pressure of 0.4 MPa) was used as a cooling medium, a rail web area of a to-be-cooled welded joint which was obtained by flash butt welding was subjected to an accelerated cooling, and an infrared thermometer was used for measuring temperature of a central position of the rail web of the welded joint and continuously monitoring the temperature, the cooling rate at the central position of the rail web was within a range of 19-35° C./s; when the temperature was dropped to 1,000° C., the control system automatically switched off the cooling medium, immediately stopped the accelerated cooling process, the welded joint was placed in air and naturally cooled to room temperature. The rail welded joints A21, A22, A23, A24 and A25 were obtained.

Comparative Example 1

The method was performed according to the method as depicted in the Example 1, except that a pressure of the compressed air was 0.7 MPa, when the temperature was dropped to 780° C., the control system automatically switched off the cooling medium. The rail welded joints D11, D12, D13, D14 and D15 were obtained.

Comparative Example 2

The method was performed according to the method as depicted in the Example 1, except that a pressure of the compressed air was 0.2 MPa, when the temperature was dropped to 1120° C., the control system automatically switched off the cooling medium. The rail welded joints D21, D22, D23, D24 and D25 were obtained.

Comparative Example 3

The experimental material of this comparative example was a 68 kg Steel track profile, rail head hardened (heat treated) pearlite rail which was stipulated by AS 1085.1: Railway track materials, Part 1: Rails, the measured carbon content of the chemical composition of the rail entity was 0.8 wt %. Five parallel tests were performed, the specific test procedure including the steps: a welding experiment was carried out by using a GAAS80/580 rail fixed flash butt welding machine, and placing the to-be-cooled welded joint obtained by flash butt welding in air and naturally cooling to room temperature. Rail welded joints D31, D32, D33, D34 and D35 were obtained.

Example 3

The experimental material of this example was R260 hot-rolled pearlite rail having the 60E1 rail profile stipulated by BS EN 13674-1: Railway applications-Track-Rail, Part 1: Vignole railway rails 46 kg/m and above, wherein the measured carbon content of the chemical composition of the rail entity was 0.6 wt %. Five parallel experiments were conducted, and the specific procedure included the following steps: a welding experiment was carried out by using a rail mobile flash butt welding machine, an accelerated cooling device 2 (the distance between the cooling surface 4 from the rail web surface was 30 mm, the spray angle was 115°) was adopted, the compressed air (with a pressure of 0.6 MPa) was used as a cooling medium, a rail web area of a to-be-cooled welded joint which was obtained by flash butt welding was subjected to an accelerated cooling, and an infrared thermometer was used for measuring temperature of a central position of the rail web of the welded joint and continuously monitoring the temperature, the cooling rate at the central position of the rail web was within a range of 19-35° C./s; when the temperature was dropped to 900° C., the control system automatically switched off the cooling medium, immediately stopped the accelerated cooling process, the welded joint was placed in air and naturally cooled to room temperature. The rail welded joints A31, A32, A33, A34 and A35 were obtained.

Example 4

The experimental material of this example was R260 hot-rolled pearlite rail having the 60E1 rail profile stipulated by BS EN 13674-1: Railway applications-Track-Rail, Part 1: Vignole railway rails 46 kg/m and above, wherein the measured carbon content of the chemical composition of the rail entity was 0.6 wt %. Five parallel experiments were conducted, and the specific procedure included the following steps: a welding experiment was carried out by using a rail mobile flash butt welding machine, an accelerated cooling device 2 (the distance between the cooling surface 4 from the rail web surface was 20 mm, the spray angle was 110°) was adopted, the compressed air (with a pressure of 0.5 MPa) was used as a cooling medium, a rail web area of a to-be-cooled welded joint which was obtained by flash butt welding was subjected to an accelerated cooling, and an infrared thermometer was used for measuring temperature of a central position of the rail web of the welded joint and continuously monitoring the temperature, the cooling rate at the central position of the rail web was within a range of 19-35° C./s; when the temperature was dropped to 800° C., the control system automatically switched off the cooling medium, immediately stopped the accelerated cooling process, the welded joint was placed in air and naturally cooled to room temperature. The rail welded joints A41, A42, A43, A44 and A45 were obtained.

Example 5

The experimental material of this example was R260 hot-rolled pearlite rail having the 60E1 rail profile stipulated by BS EN 13674-1: Railway applications-Track-Rail, Part 1: Vignole railway rails 46 kg/m and above, wherein the measured carbon content of the chemical composition of the rail entity was 0.6 wt %. Five parallel experiments were conducted, and the specific procedure included the following steps: a welding experiment was carried out by using a rail mobile flash butt welding machine, an accelerated cooling device 2 (the distance between the cooling surface 4 from the rail web surface was 15 mm, the spray angle was 112°) was adopted, the compressed air (with a pressure of 0.4 MPa) was used as a cooling medium, a rail web area of a to-be-cooled welded joint which was obtained by flash butt welding was subjected to an accelerated cooling, and an infrared thermometer was used for measuring temperature of a central position of the rail web of the welded joint and continuously monitoring the temperature, the cooling rate at the central position of the rail web was within a range of 19-35° C./s; when the temperature was dropped to 1,100° C., the control system automatically switched off the cooling medium, immediately stopped the accelerated cooling process, the welded joint was placed in air and naturally cooled to room temperature. The rail welded joints A51, A52, A53, A54 and A55 were obtained.

Example 6

The experimental material of this example was R400HT hot-treated pearlite rail having the 60E2 rail profile stipulated by BS EN 13674-1: Railway applications-Track-Rail, Part 1: Vignole railway rails 46 kg/m and above, wherein the measured carbon content of the chemical composition of the rail entity was 0.9 wt %. Five parallel experiments were conducted, and the specific procedure included the following steps: a welding experiment was carried out by using a rail mobile flash butt welding machine, an accelerated cooling device 2 (the distance between the cooling surface 4 from the rail web surface was 25 mm, the spray angle was 110°) was adopted, the compressed air (with a pressure of 0.4 MPa) was used as a cooling medium, a rail web area of a to-be-cooled welded joint which was obtained by flash butt welding was subjected to an accelerated cooling, and an infrared thermometer was used for measuring temperature of a central position of the rail web of the welded joint and continuously monitoring the temperature, the cooling rate at the central position of the rail web was within a range of 19-35° C./s; when the temperature was dropped to 900° C., the control system automatically switched off the cooling medium, immediately stopped the accelerated cooling process, the welded joint was placed in air and naturally cooled to room temperature. The rail welded joints A61, A62, A63, A64 and A65 were obtained.

Example 7

The experimental material of this example was HH railhead hardened (heat-treated) pearlite rail having the 136RE rail profile stipulated by AMERICAN RAILWAY ENGINEERING AND MAINTENANCE-OF-WAY ASSOCIATION (AREMA), Part 1: Design of Rail, wherein the measured carbon content of the chemical composition of the rail entity was 0.86 wt %. Five parallel experiments were conducted, and the specific procedure included the following steps: a welding experiment was carried out by using a GAAS80/580 rail fixed flash butt welding machine, an accelerated cooling device 2 (the distance between the cooling surface 4 from the rail web surface was 5 mm, the spray angle was 110°) was adopted, the compressed air (with a pressure of 0.3 MPa) was used as a cooling medium, a rail web area of a to-be-cooled welded joint which was obtained by flash butt welding was subjected to an accelerated cooling, and an infrared thermometer was used for measuring temperature of a central position of the rail web of the welded joint and continuously monitoring the temperature, the cooling rate at the central position of the rail web was within a range of 19-35° C./s; when the temperature was dropped to 950° C., the control system automatically switched off the cooling medium, immediately stopped the accelerated cooling process, the welded joint was placed in air and naturally cooled to room temperature. The rail welded joints A71, A72, A73, A74 and A75 were obtained.

Example 8

The experimental material of this example was HH railhead hardened (heat-treated) pearlite rail having the 136RE rail profile stipulated by AMERICAN RAILWAY ENGINEERING AND MAINTENANCE-OF-WAY ASSOCIATION (AREMA), Part 1: Design of Rail, wherein the measured carbon content of the chemical composition of the rail entity was 0.86 wt %. Five parallel experiments were conducted, and the specific procedure included the following steps: a welding experiment was carried out by using a GAAS80/580 rail fixed flash butt welding machine, an accelerated cooling device 2 (the distance between the cooling surface 4 from the rail web surface was 15 mm, the spray angle was 115°) was adopted, the compressed air (with a pressure of 0.5 MPa) was used as a cooling medium, a rail web area of a to-be-cooled welded joint which was obtained by flash butt welding and was subjected to an accelerated cooling, and an infrared thermometer was used for measuring temperature of a central position of the rail web of the welded joint and continuously monitoring the temperature, the cooling rate at the central position of the rail web was within a range of 19-35° C./s; when the temperature was dropped to 1,000° C., the control system automatically switched off the cooling medium, immediately stopped the accelerated cooling process, the welded joint was placed in air and naturally cooled to room temperature. The rail welded joints A81, A82, A83, A84 and A85 were obtained.

Test Example 1

Figure 2:
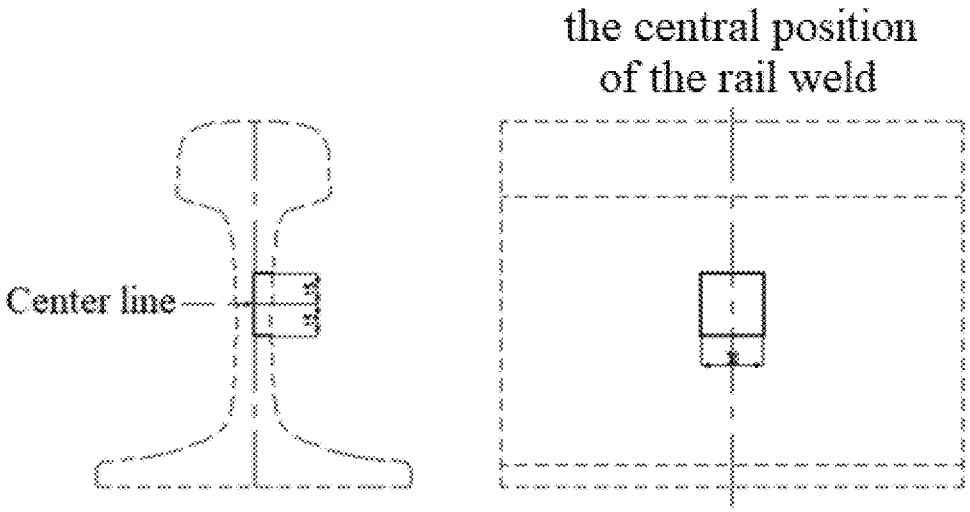
FIG. 2 is a schematic view of the microstructure sampling locations of the rail welded joint for the example and comparative example of test example 1.

One welded joint was selected from the rail welded joints obtained from the Examples and the Comparative Examples, respectively, the selected welded joints were denoted as A11, A21, A31, A41, A51, A61, A71, A81, D11, D21 and D31, respectively. The sampling was performed at the central position of the rail web by means of the Wire Electrical Discharge Machining (WEDM), the sampling position was shown in FIG. 2. The microstructure inspection method was carried out, that is, a nitric acid alcohol solution was prepared from 4 vol % nitric acid and 96 vol % anhydrous ethanol, the sample in a polished state was subjected to corrosion by the nitric acid alcohol solution at a normal temperature for about 15 s, an optical electron microscope was then adopted for observing the microstructure.

The obvious intergranular cementite microstructure was not detected on the observing surfaces of the sampling position of the rail welded joints in Examples 1 to 8.

Figure 3:
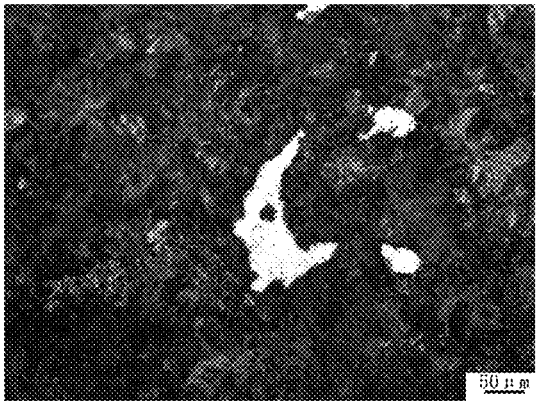
FIG. 3 illustrates a microstructure diagram showing the sampling test of comparative example 1 in test example 1.

Although the obvious intergranular cementite microstructure was not detected on the observing surface of the sampling position of the rail welded joint of the Comparative example 1, a large amount of martensite was discovered at the inspection site. The microstructure was shown in FIG. 3, it did not meet the requirements.

Figure 4:
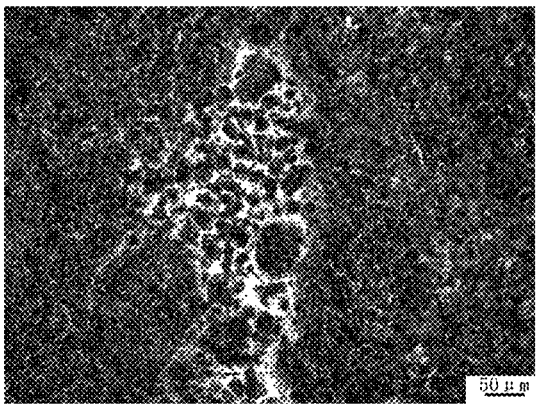
FIG. 4 illustrates a microstructure diagram showing the sampling test of comparative example 2 in test example 1.

The obvious intergranular cementite microstructure was detected on the observing surface of the sampling position of the rail welded joint of the Comparative example 2, the microstructure was shown in FIG. 4, it did not meet the requirements.

Figure 5:
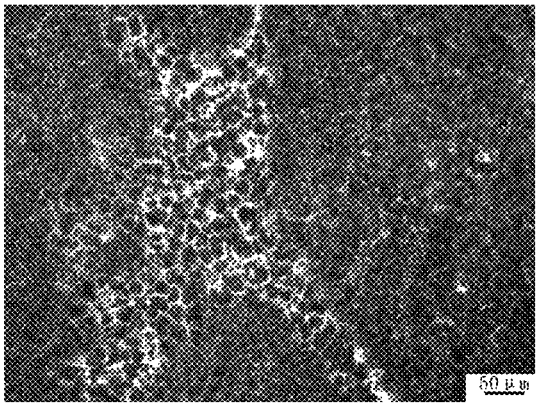
FIG. 5 illustrates a microstructure diagram showing the sampling test of comparative example 3 in test example 1.

The obvious intergranular cementite microstructure was detected on the observing surface of the sampling position of the rail welded joint of the Comparative example 3, the microstructure was shown in FIG. 5, it did not meet the requirements.

Test Example 2

Four welded joints were selected from the rail welded joints obtained from the Examples 1-2 and the Comparative Examples 1-3, respectively, wherein one welded joint was subjected to the hardness testing, the welded joints were denoted as A12, A22, D12, D22, D32, and the other three welded joints were subjected to the slow bend test, the welded joints were denoted as A13, A14, A15, A23, A24, A25, D13, D14, D15, D23, D24, D25, D33, D34, D35, respectively. Both the hardness and the slow bend tests were performed according to AS 1085.20, Railway track material, Part 20: Welding of rail. The test results for the lowest and highest hardness values of the longitudinal sections of the joints were shown in Table 1, the test results in regard to the maximum deflection value when the maximum stress of the rail flange during the slow bend tests was 910 MPa and whether a fracture occurred were shown in Table 1.

As can be seen from the results in Table 1, the results of the hardness test and the slow bend test for the rail joints obtained in Examples 1-2 and Comparative Examples 1-3 can meet the standard requirements.

TABLE 1

| Numbers | Lowest value (HV) | Highest Value (HV) | Maximum deflection value (mm) | Whether a fracture occurred |
|---|---|---|---|---|
| Example 1 | 378 | 425 | 13.6 | Not |
| Example 2 | 377 | 422 | 13.9 | Not |
| Comparative example 1 | 375 | 424 | 13 | Not |
| Comparative example 2 | 379 | 426 | 13.9 | Not |
| Comparative example 3 | 375 | 422 | 13.2 | Not |

Test Example 3

Four welded joints were selected from the rail welded joints obtained from the Examples 3-6, respectively, wherein one welded joint was subjected to the hardness testing, the welded joints were denoted as A32, A42, A52, A62, and the other three welded joints were subjected to the slow bend test, the welded joints were denoted as A33, A34, A35, A43, A44, A45, A53, A54, A55, A63, A64, A65, respectively. Both the hardness and the slow bend tests were performed according to BS EN 14587-2: Railway applications-Track-Flash butt welding of rails, Part 2: New R220, R260, R260Mn and R350HT grade rails by mobile welding machines at sites other than a fixed plant. The test results for the lowest and highest hardness values of the longitudinal sections of the joints were shown in Table 2, the test results in regard to the maximum deflection values for the slow bend tests at a maximum load of 1,610 kN and whether a fracture occurred were shown in Table 2.

As can be seen from the results in Table 2, the results of the hardness and the slow bend tests for the rail joints obtained in Examples 3-6 can meet the standard requirements.

TABLE 2

| Numbers | Lowest value (HV) | Highest Value (HV) | Maximum deflection value (mm) | Whether a fracture occurred |
|---|---|---|---|---|
| Example 3 | 258 | 338 | 23.2 | Not |
| Example 4 | 259 | 339 | 22.9 | Not |
| Example 5 | 258 | 339 | 23.4 | Not |
| Example 6 | 410 | 445 | 21.5 | Not |

Test Example 4

Four welded joints were selected from the rail welded joints obtained from the Examples 7-8, respectively, wherein one welded joint was subjected to the hardness testing, the welded joints were denoted as A72, A82, and the other three welded joints were subjected to the slow bend test, the welded joints were denoted as A73, A74, A75, A83, A84, A85, respectively. Both the hardness and the slow bend tests were performed according to AMERICAN RAILWAY ENGINEERING AND MAINTENANCE-OF-WAY ASSOCIATION (AREMA), CHAPTER 4, Part 3: Joining of Rail. The test results for the lowest and highest hardness values of the longitudinal sections of the joints were shown in Table 3, the test results in regard to the maximum deflection values when the maximum stress of the rail flange during the slow bend tests was 125,000 lbs/in2 and whether a fracture occurred were shown in Table 3.

As can be seen from the results in Table 3, the results of the hardness and the slow bend tests for the rail joints obtained in Examples 7-8 can meet the standard requirements.

TABLE 3

| Numbers | Lowest value (BHN) | Highest Value (BHN) | Maximum deflection value (inch) | Whether a fracture occurred |
|---|---|---|---|---|
| Example 7 | 358 | 390 | 0.79 | Not |
| Example 8 | 356 | 393 | 0.81 | Not |

The above content describes in detail the preferred embodiments of the present disclosure, but the present disclosure is not limited thereto. A variety of simple modifications can be made in regard to the technical solutions of the present disclosure within the scope of the technical concept of the present disclosure, including a combination of individual technical features in any other suitable manner, such simple modifications and combinations thereof shall also be regarded as the content disclosed by the present disclosure, each of them falls into the protection scope of the present disclosure.

What is claimed is:

1. A method for making a welded joint for a rail, comprising the following steps:

Step 1): subjecting a rail web area of the welded joint which is obtained by flash butt welding to a cooling by means of an accelerated cooling device and by using compressed air as a cooling medium, measuring and monitoring temperature of a central position of the rail web area at a weld of the welded joint while cooling;

Step 2): stopping the cooling when the temperature of the central position of the rail web area of the welded joint drops to a preset temperature, then placing the welded joint in air and naturally cooling to room temperature;

wherein the rail is a pearlite rail having a carbon content of 0.6-0.9 wt %;

wherein a cooling rate at the central position of the rail web area of the welded joint during the cooling process in step 1) is larger than 18° C./s;

wherein the preset temperature in step 2) is within a range of 800-1,100° C.

2. The method of claim 1, wherein a pressure of the compressed air in step 1) is within a range of 0.3-0.6 MPa.

3. The method of claim 1, wherein the rail is a hot-rolled pearlite rail and/or a heat-treated pearlite rail.

4. The method of claim 1, wherein the accelerated cooling device in step 1) includes a cavity structure comprising a cooling medium inlet surface through which the cooling medium enters the accelerated cooling device, and a cooling surface through which the cooling medium is ejected.

5. The method of claim 4, wherein a distance between the cooling surface of the accelerated cooling device and the rail web surface in step 1) is within a range of 5-35 mm.

6. The method of claim 1, wherein the rail web area of the welded joint in step 1) comprises a region having a height of two-thirds of the rail height along the height direction and a region having a width extending 40 mm outwardly from a heat affected zone of the welded joint along the width direction.

7. The method of claim 6, wherein the rail web area of the welded joint in step 1) comprises a region having a height extending 20-30 mm from a centerline of the weld to both sides along the height direction of the rail, and a region having a width extending 40-60 mm outwardly from a centerline of the weld along the width direction.

8. The method of claim 1, wherein the cooling rate at the central position of the rail web area of the welded joint is within a range of 19-35° C./s.

9. The method of claim 1, wherein a microstructure of the welded joint is free from intergranular cementite and untempered martensite.

* * * * *